US011485456B1

(12) United States Patent
Casey

(10) Patent No.: US 11,485,456 B1
(45) Date of Patent: Nov. 1, 2022

(54) TABLE EASILY ATTACHABLE TO POWERED BOATS

(71) Applicant: Paul J Casey, Salem, NH (US)

(72) Inventor: Paul J Casey, Salem, NH (US)

( * ) Notice: Subject to any disclaimer, the term of this patent is extended or adjusted under 35 U.S.C. 154(b) by 0 days.

(21) Appl. No.: 17/492,571

(22) Filed: Oct. 2, 2021

(51) Int. Cl.
*B63B 29/04* (2006.01)
*A47B 13/16* (2006.01)

(52) U.S. Cl.
CPC ..... *B63B 29/04* (2013.01); *A47B 13/16* (2013.01); *B63B 2029/046* (2013.01)

(58) Field of Classification Search
CPC .... B63B 29/04; B63B 2029/046; A47B 13/16
See application file for complete search history.

(56) References Cited

U.S. PATENT DOCUMENTS 5,185,892 A * 2/1993 Mitchell ..... A47K 3/122 297/14
6,101,966 A * 8/2000 Cumisky ..... B63B 29/04 114/364
6,789,494 B2 * 9/2004 Neese ..... B63B 29/04 297/14
6,904,863 B2 * 6/2005 Mardikian ..... B63B 27/146 114/362
9,340,258 B1 * 5/2016 Long ..... B63B 17/00
9,663,197 B2 * 5/2017 Bires ..... B63B 29/04
9,914,507 B2 * 3/2018 Falahee ..... H02J 3/381
9,914,508 B2 * 3/2018 Neese ..... B63B 29/04
10,843,775 B2 * 11/2020 Todd ..... B60R 9/06
2007/0035166 A1 * 2/2007 Summerford ..... A47C 9/06 297/331
2014/0261133 A1 * 9/2014 Dorton ..... B63B 27/146 114/271
2020/0055573 A1 * 2/2020 Miller ..... B63B 27/146

* cited by examiner

*Primary Examiner* — S. Joseph Morano
*Assistant Examiner* — Jovon E Hayes

(57) ABSTRACT

Disclosed are embodiments of a table assembly for a boat docked near a landing. The table assembly consists of three essential components: (1) a table having an upper surface and an underside surface; and (2) a leveling mechanism secured to the underside surface. In one embodiment, a third essential component is: (3A) a pair of hooks secured to the leveling mechanism. In another embodiment, a third essential component is: (3B) a pair of claws secured to the table underside surface.

8 Claims, 10 Drawing Sheets

500B

402B 508B
500B
504B
502B 460B
506B
504B
204
502B 204
500B

TABLE EASILY ATTACHABLE TO POWERED BOATS

FIELD

The present subject matter, in general, is for a table attachable to a boat and, more particularly, is for a table easily attachable to powered boats at the stern.

BACKGROUND

When a powered boat is docked and the weather is favorable, provided that a boater has time to participate in social and leisure activities taking place and that there is ample area to prepare food and beverages, it is often desirable to be able to attach a table to one's boat quickly, in order to participate in activities occurring in and around the dock area. In searching for tables easily attachable to boats with minimal effort, the following US patents and published application were reviewed.

U.S. Pat. No. 6,101,966 to Cumisky, directed to a multi-purpose utility station, discloses a table that must be secured by brackets to the stern of a boat. U.S. Pat. No. 9,663,197 to Bires discloses a table having legs that are either screwed to the deck of a boat or mounted within cup-shaped apertures that are formed within the deck.

U.S. Pat. No. 9,914,507 to Falahee discloses a table assembly horizontally extendable from and retractable into guide structure attached to an underside surface of the deck. U.S. Pat. No. 9,914,508 to Neese discloses a folding step that, while useable as a temporary table, must be secured to a boat wall by a bracket.

US published application 2007/0035166 to Summerford discloses a folding boat seat that, while possibly useable as a temporary table, must be permanently secured to a bulkhead of the boat by special hardware such as a pair of guide plates.

These US patents and published application do not disclose tables or other structure that could serve as a table and be attached to boats with minimal effort.

While the noted prior art discloses tables and other structure possibly serving as a table for powered boats that are docked, all such tables and other structure possibly serving as a table must be permanently secured to docked power boats with special hardware. Permanently securing tales to boats requires effort. My table assembly embodiments of the present subject matter, in comparison, can be temporarily secured to boats, and easily removed after use with minimal effort.

SUMMARY

Embodiments of my table assembly for a boat docked near a landing, the subject matter of this patent application, consist of three essential components. Two of the essential components are: (1) a table having an upper surface and an underside surface; and (2) a leveling mechanism secured to the underside surface.

In one embodiment, the third essential component is: (3A) a pair of hooks secured to the leveling mechanism. In another embodiment, the third essential component is: (3B) a pair of claws secured to the underside surface of the table.

Embodiments of my table assembly are used in connection with a boat having a stern and a horizontal bar—which I call a grab bar—secured to the stern.

In the one embodiment, the pair of hooks engage the horizontally oriented grab bar for purposes of temporarily mounting the table assembly securely to the stern. In another embodiment, the pair of claws engage the horizontally oriented bar for purposes of temporarily attaching the table assembly securely to the stern. In embodiments, an end portion of the leveling mechanism abuts the stern, for orienting the upper surface of the table substantially level in relation to the landing.

BRIEF DESCRIPTION OF THE DRAWINGS

Throughout the drawing figures and detailed description, I shall use similar reference numerals to refer to similar components of the present subject matter.

DETAILED DESCRIPTION

Figure 1:
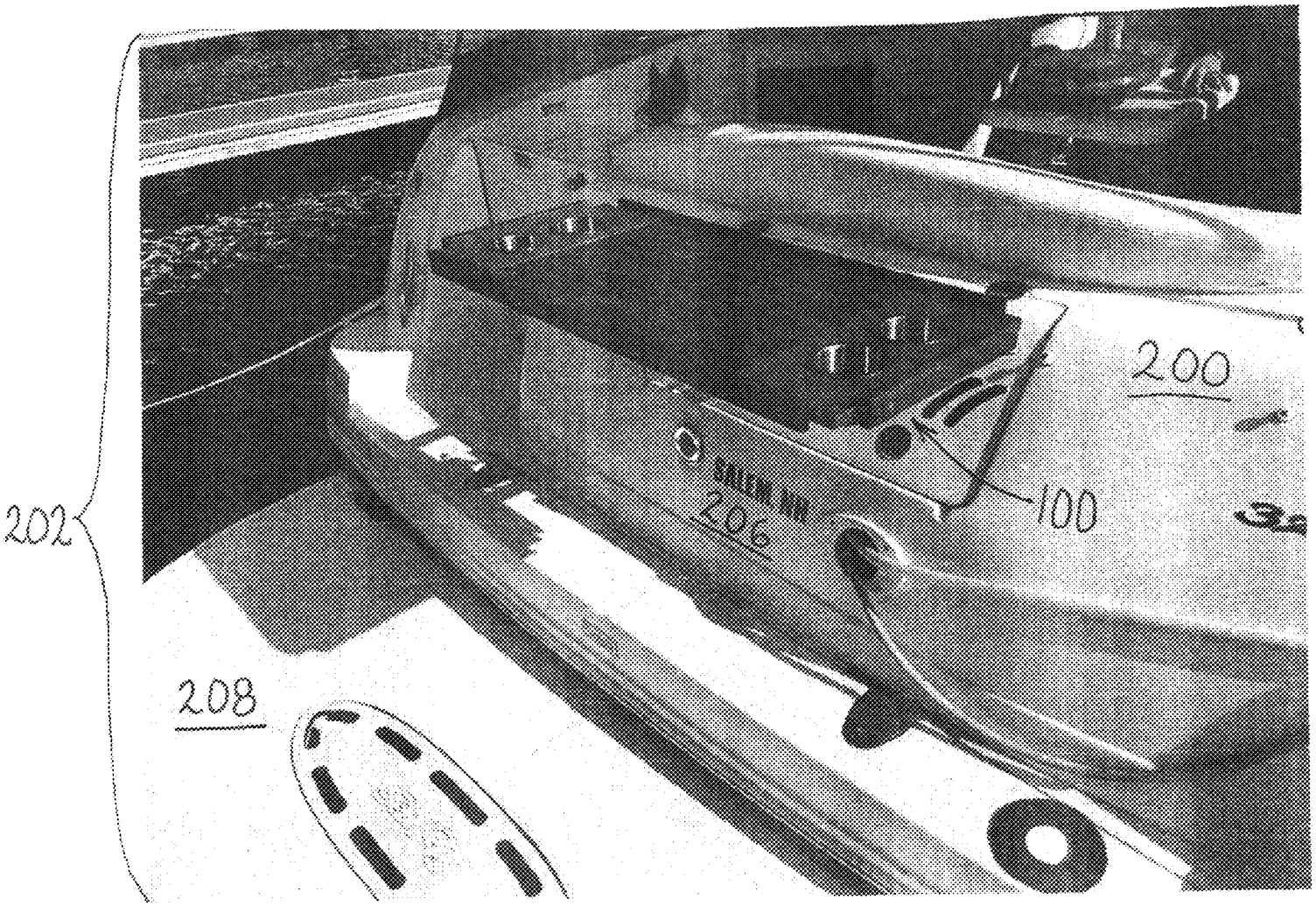
FIG. 1 is a perspective view of one embodiment of the present subject matter which is a table assembly for a powered boat that is docked near a landing.

Referring initially to FIG. 1, my novel table assembly 100 was designed for a boat 200 docked near a landing 202. In particular, my novel table assembly 100 was designed to be temporarily securely mounted to a grab bar 204 (see FIG. 2).

As used throughout this patent specification, the term "grab bar" shall refer to an elongated member secured horizontally to the stern 206 of the boat 200. The boat 200 (shown in FIGS. 1, 2) is powered and includes a swim platform 208 extending on the water away from a region of the boat 200 adjacent the stern 206. My table assembly 100, designed for a boat 200 docked near a landing 202, consists of three essential structural components which I shall now describe in detail below.

One essential structural component of my table assembly 100 designed for a boat 200 is a table component, of which I have provided illustrated embodiments.

A first embodiment of the table assembly 100 of the present subject matter has as an essential component a table 300A (FIG. 3A) having a rectangular shape and an upper surface 302A that is provided by a plurality of spaced-apart elongated boards 304A oriented parallel along the long dimension of rectangular table 300A.

Overlaying opposite end portions of the plurality of boards 304A are an identical pair of spaced-apart platforms 306*k* Each platform 306A is rectangular in shape and is arranged so that its longer edge portion is located adjacent the shorter edge portion of the rectangular table 300*k* Each platform 306A includes a pair of circular spaced-apart holes or apertures 308A. Attached to each of the two longer edges of the rectangular table 300A is a respective one of a pair of spaced-apart longer boards 310A and attached to each of the two shorter edges of rectangular the table 300A is a respective one of a pair of spaced-apart shorter boards 312A.

Each of the longer boards 310A and each of the shorter boards 312A have a rectangular cross section along their length. The rectangular cross section of the longer boards 310A and the shorter boards 312A provides each one of these boards—namely the longer boards 310A and the shorter boards 312A—with a pair of spaced-apart wider edge portions and a pair of spaced-apart narrower edge portions for each board 310A, 312A, The longer boards 310A and shorter boards 312A, secured to the perimeter of rectangular table 300A, are arranged in a manner so that their narrower edge portions extend upwardly from the upper surface 302A of the rectangular table 300A, and provide a wall 314A that surrounds the entire upper surface 302A along the perimeter of the table 300A, except for the open corner portions 316A at outer corners of the platforms 306A, a decorative feature.

A second embodiment of the table assembly 100 of the present subject matter has as an essential component a similar table 300B (FIG. 3B), with at least one difference. The longer boards 310B and shorter boards 3128, secured to the perimeter of rectangular table 300B, are arranged in a manner so that the narrower edge portions of boards 310B, 312B extend upwardly from the upper surface 302B of rectangular table 300B, and provide a side wall 314B along the entire perimeter of the table 300B, that includes the four smoothly closed-off corner portions 316B.

Also, the upper surface 302B of rectangular table 300B (FIG. 3B) includes a pair of platforms 306B arranged at opposite ends of the plurality of elongated boards 3048, with each platform holding a pair of spaced-apart stainless steel containers 318B, shaped and sized to be secured within each respective one of the pair of openings or apertures (not shown in FIG. 3B) of the rectangular table 3008.

Another embodiment of a rectangular table 300C of the present subject matter (FIG. 3C) has two open corner portions 316C that are somewhat similar to the open corner portions 316A of rectangular table 300A (FIG. 3A), but which are unlike the four open corner portions 316A of table 312A for the reason that this embodiment of the rectangular table 300C has a single platform 306C at the edge portion of table 300C located adjacent the stern 206. Also, this platform 306C, with each of a plurality of apertures (not shown) containing respective ones of an associated plurality of appropriately dimensioned stainless steel containers 318C, provides this embodiment of the table 300C with two closed corner portions 317C.

Figure 3A:
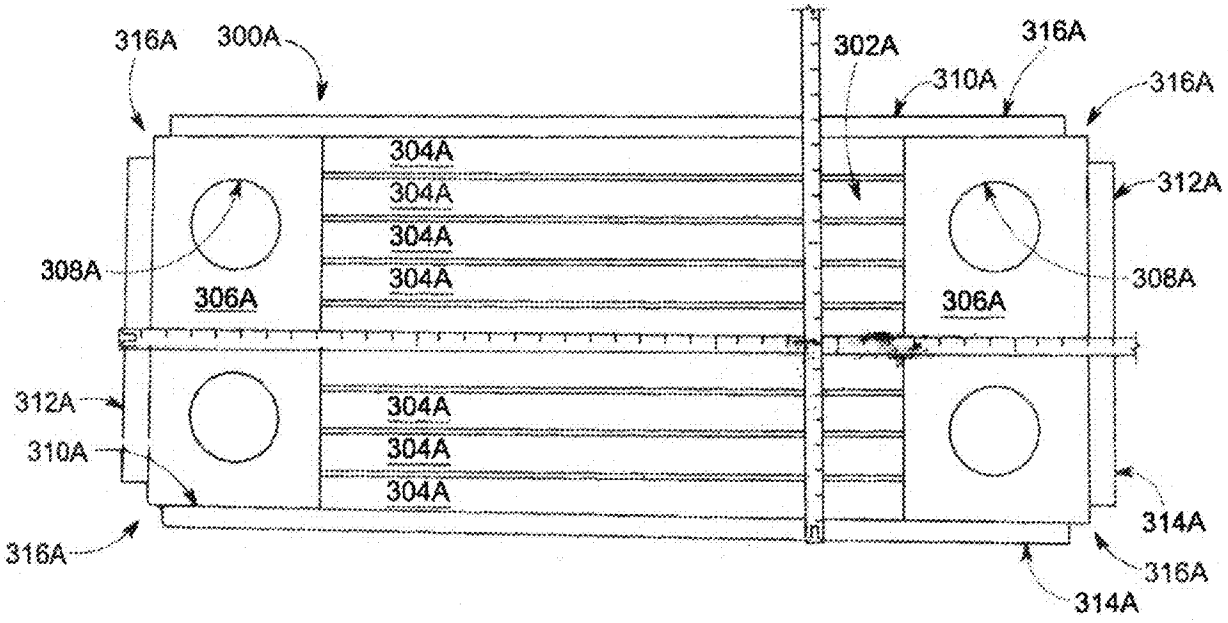
FIG. 3A is an upper surface of a table of the embodiment shown in FIG. 1.
Figure 3B:
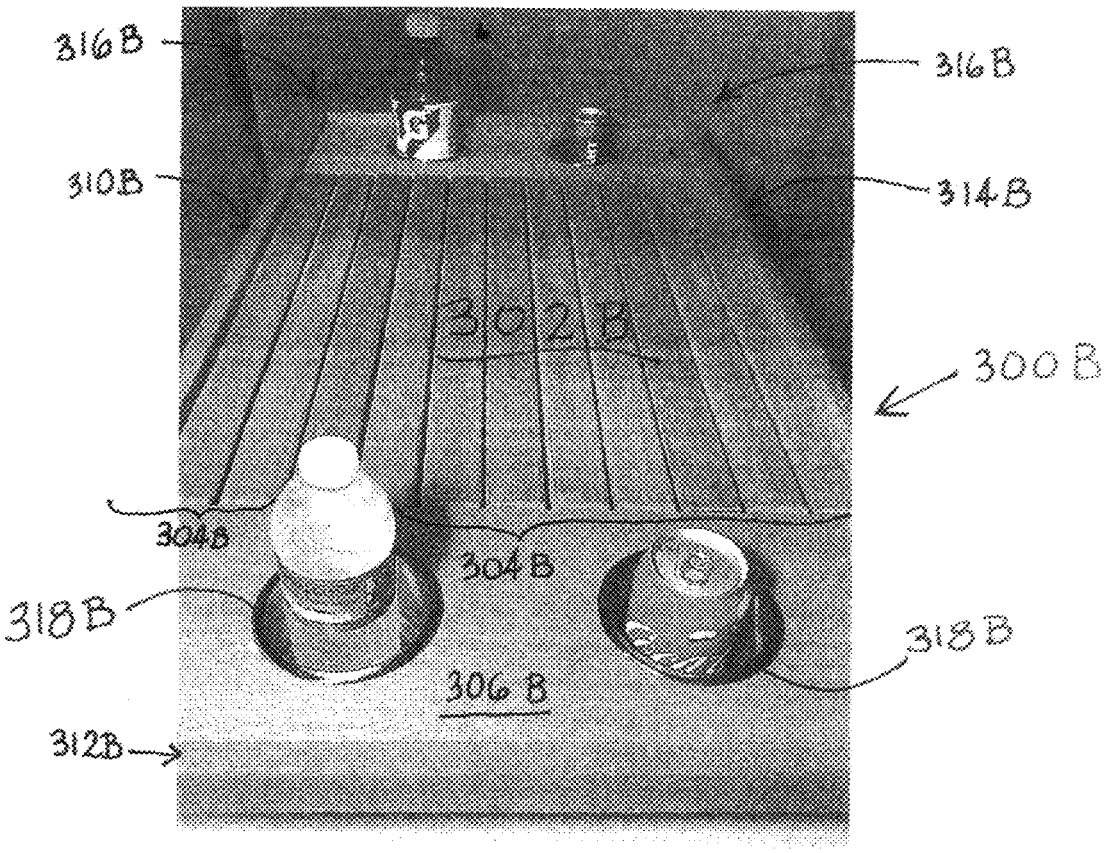
FIG. 3B is an upper surface of a table component of the other embodiment.
Figure 3D:
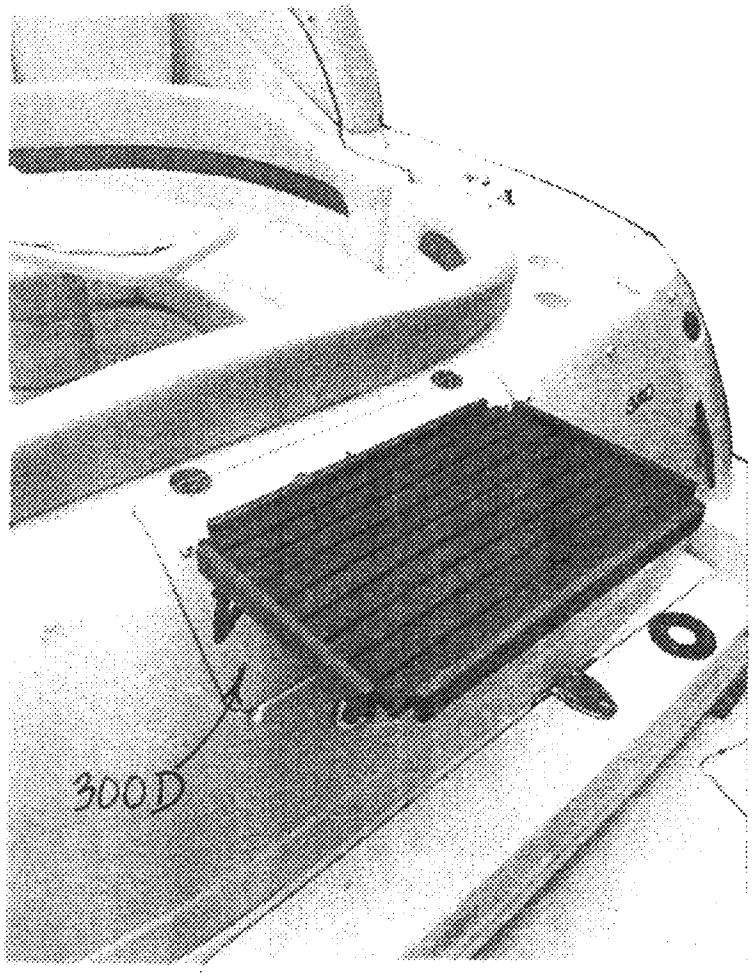
FIGS. 3C, 3D present additional embodiments of the present subject matter.
Figure 3C:
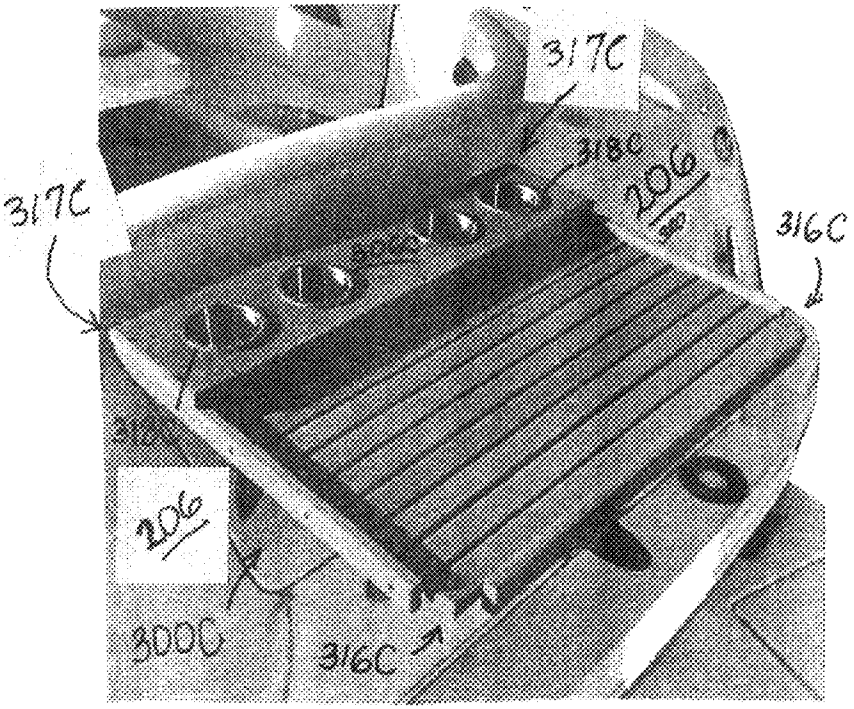

Still another embodiment of a rectangular table 300D (FIG. 3D) that is illustrative of the present subject matter resembles the rectangular table 300A of the first embodiment, except that it does not include the spaced-apart platforms 306A having plural openings or apertures 308A (FIG. 3A). Also, a width dimension for this embodiment of the rectangular table 300D (FIG. 3D) is noticeably less than a width dimension of the rectangular table 300A (FIG. 3A) of the first embodiment.

While those of ordinary skill in this field involving boats docked near a landing are aware that tables embodying the present subject matter can assume various shapes and sizes, the following information is given to provide a detailed description of the present subject matter. Physical dimensions of the rectangular table 300D (FIG. 3D) are about thirty inches, plus or minus one inch wide, by about twenty-three inches, plus or minus one inch, deep. Also, the rectangular table 300A (FIG. 3A) and the rectangular table 300B (FIG. 3B) of the first and second embodiments of the table assembly of the present subject matter can have a width edge margin value and a depth edge margin value, wherein a ratio defined as the width edge margin value divided by the depth edge margin value ranges from about 2.25 to about 2.5; also, the width edge margin value of the upper surface of tables disclosed ranges from about three feet, two inches to about three feet, ten inches. The term "depth" shall be understood to refer to a distance value from the outermost edge portion of the table surface to the surface of the stern of the boat.

Figure 4A:
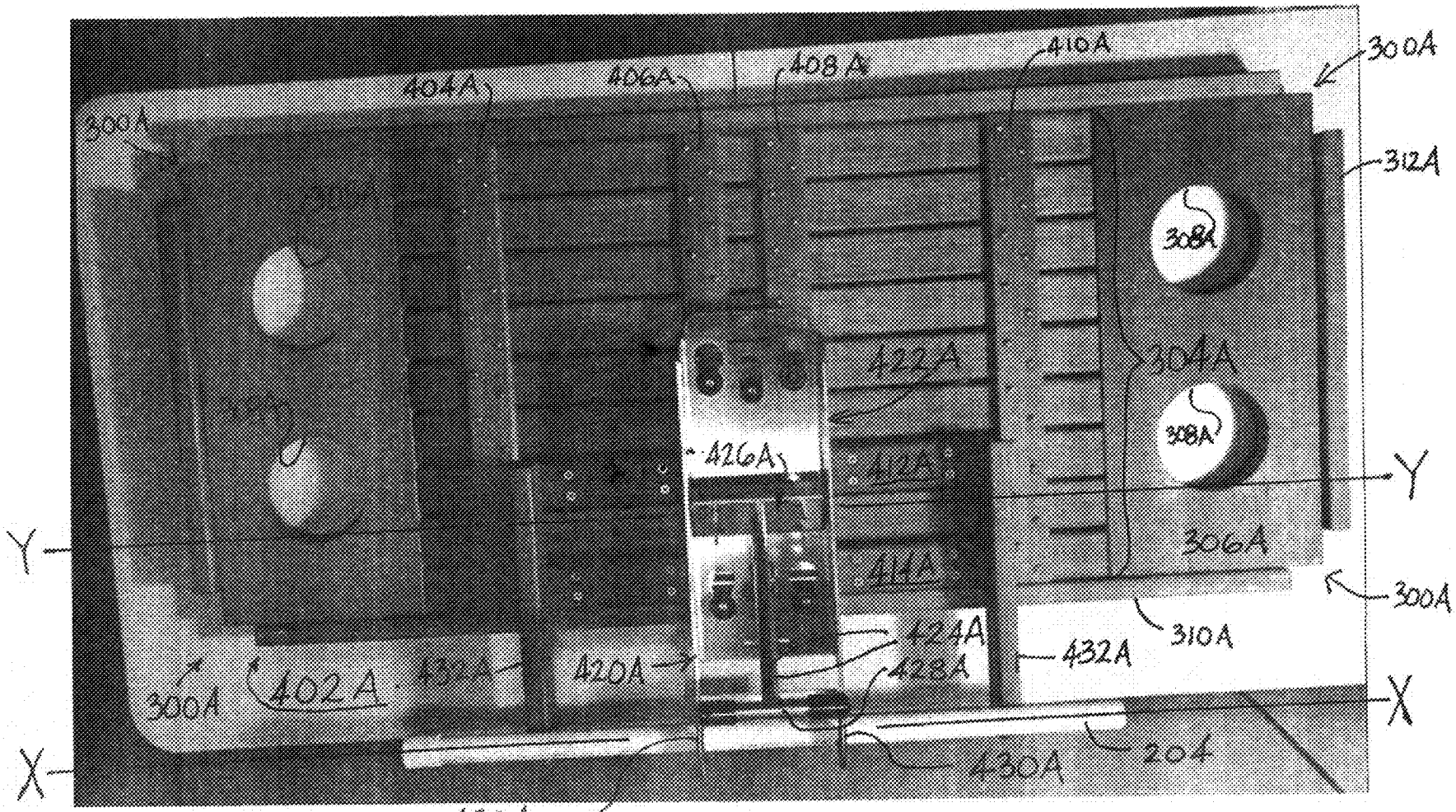
FIG. 4A is an underside surface of the table component shown in FIG. 3A.

An underside surface 402A (FIG. 4A) of my rectangular table 300A (shown in FIG. 3A) of the present subject matter includes four spaced-apart underside boards 404A, 406A, 408A, and 410A. The underside surface 402A also includes the plurality of spaced-apart elongated boards 304A (see FIG. 3A). Each one of the plurality of elongated boards 304A is secured to the spaced-apart underside boards 404A, 406A, 408A, and 410A (as shown in FIG. 4A). The underside surface 402A (FIG. 4A) of table 300A (FIG. 3A) also includes a pair of spaced-apart underside crosspieces 412A and 414A. The four spaced-apart underside boards 404A, 406A, 408A, and 410A are oriented transverse to the plurality of spaced-apart elongated boards 304A. Of the four spaced-apart underside boards (404A, 406A, 408A, and 410A), two of the underside boards 406A and 408A are arranged between the other two underside boards 404A and 410A. The length of the inner-arranged boards 406A and 408A is less than the length of the outer-arranged boards 404A and 410A, which enables the pair of spaced-apart crosspieces 412A and 414A to be secured parallel to select boards 304A between the outer-arranged underside boards 404A and 410A without overlaying the inner-arranged underside boards 406A and 408A.

The first embodiment of the table assembly 100 of the present subject matter further includes a leveling mechanism 420A (FIG. 4A), another essential component of the table assembly 100 in addition to the table 300*k* The leveling mechanism 420A is secured to the underside surface 402A (FIG. 4A) of table 300A.

The leveling mechanism 420A includes a bracket 422A (FIG. 4A) secured to the underside surface 402A of the table 300*k* The leveling mechanism 420A also includes a leveling member 424A having opposite end portions 426A and 428*k* One end portion 426A of the leveling member 424A is pivotally mounted to the bracket 422A and is pivotable about an axis Y-Y (FIG. 4A). The opposite end portion 428A (of the leveling member 424A) defines a foot, which after being rotated about axis Y-Y, is configured to abut the stern 206 (FIG. 2) of the boat 200 (FIG. 1).

The first embodiment of the table assembly 100 also includes a spaced-apart pair of hooks 430A, each secured to the leveling mechanism 420A. The two hooks 430A are yet another essential component of the table assembly 100 of the present subject matter in addition to the table 300A and the leveling mechanism 420A.

Figure 4B:
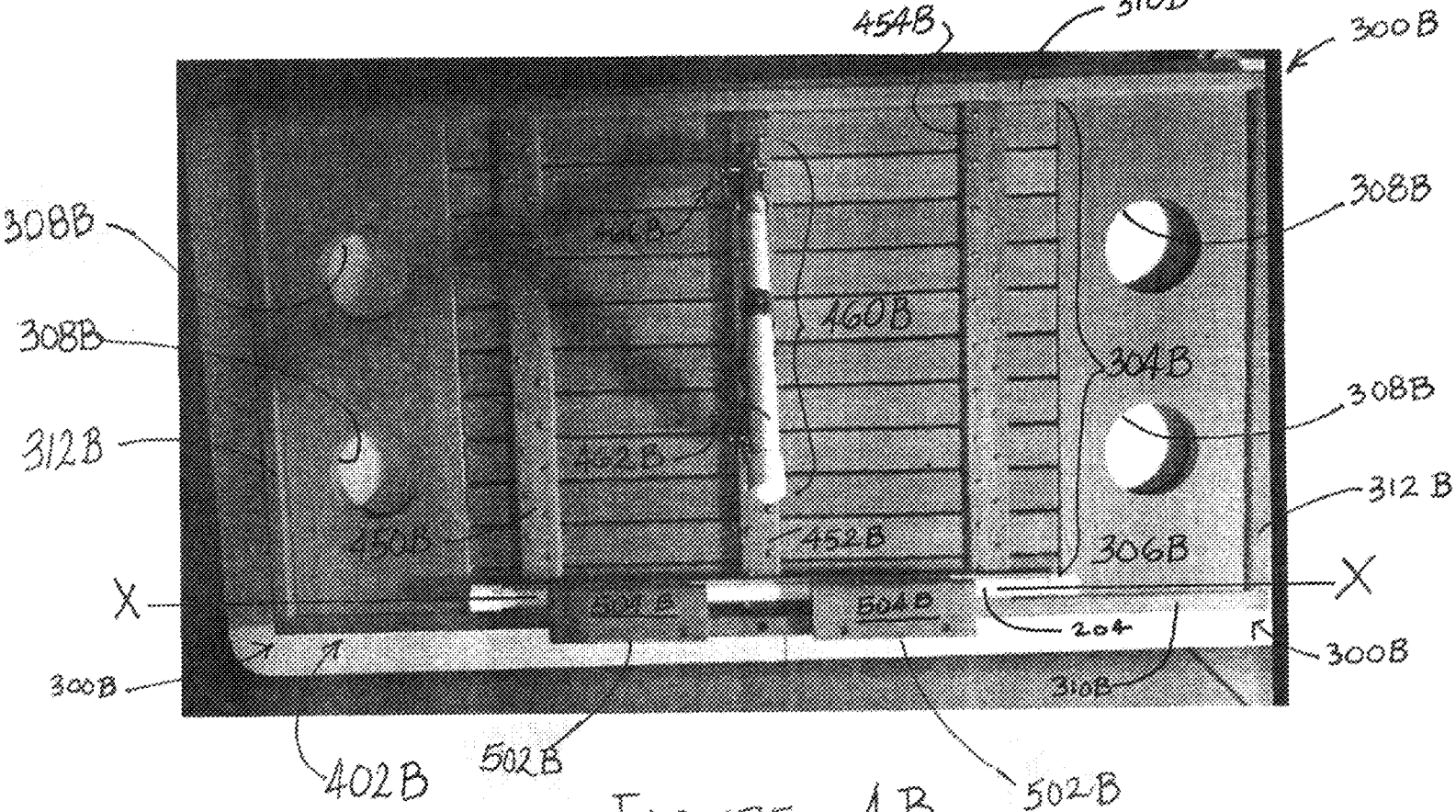
FIG. 4B is an underside surface of the table component shown in FIG. 3B.

As shown in FIGS. 4A and 4B, grab bar 204 is arranged along an axis X-X which is substantially parallel to swim platform 208 (FIG. 1). In addition, the axis X-X along which the grab bar 204 is oriented is parallel to the axis Y-Y about which the noted one end portion 426A of the leveling member 424A is pivotable for positioning the foot of the opposite end portion 428A of the leveling member 424A against the stern 206 of the boat 200 in order to level table 300A as desired.

Figure 2:
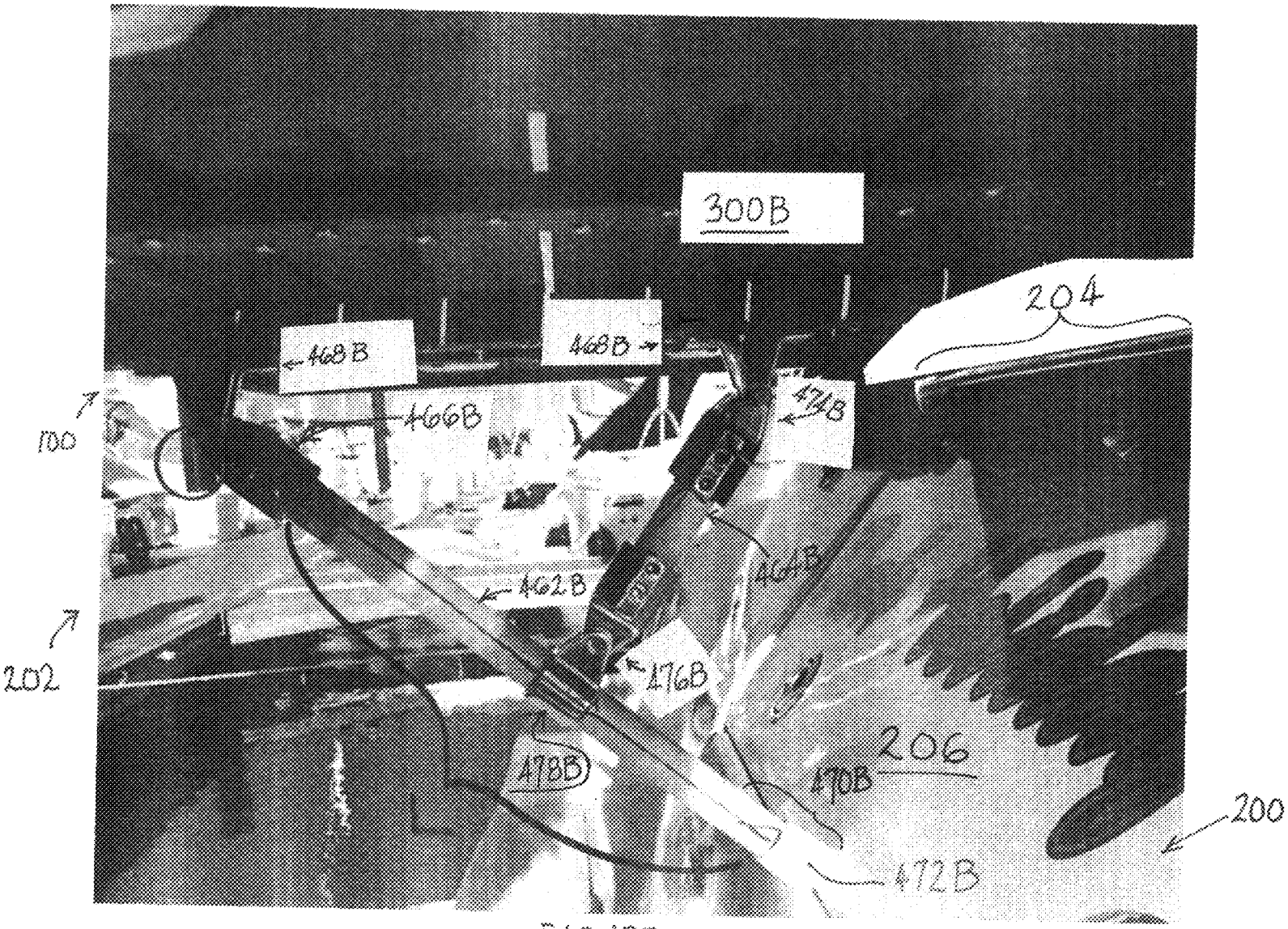
FIG. 2 is a side elevational view of a component of another embodiment.

Also secured to the underside surface 402A of table 300A are a spaced-apart pair of projecting members (or projections) 432A extending away from table 300A toward the stern 206 (FIG. 2). The projections 432A straddle the hooks 430A; and each projection 432A has an end portion that abuts the grab bar 204 (FIG. 4A).

An underside surface 402B (FIG. 4B) of my other rectangular table 300B (please see FIG. 3B) of the present subject matter includes three spaced-apart underside boards 450B, 452B, and 454B. The underside surface 402B of rectangular table 300B further includes the plurality of spaced-apart elongated boards 304B (please refer to FIG. 3B). Each one of the plurality of elongated boards 304B is secured to each one of the spaced-apart underside boards 450B, 452B, and 454B (by wood screws as shown in FIG. 4B). The underside boards 450B, 452B, and 454B are oriented perpendicular to the plurality of elongated boards 304B with one underside board 452B being spaced equally between the other two underside boards 450B and 454B. Another embodiment of a table leveling mechanism 460B—another essential component of this particular embodiment of my novel table assembly 100 of the present subject matter, in addition to the table 3008 (shown in FIG. 3B)—is longitudinally secured to centrally-arranged underside board 4528.

Figure 4C:
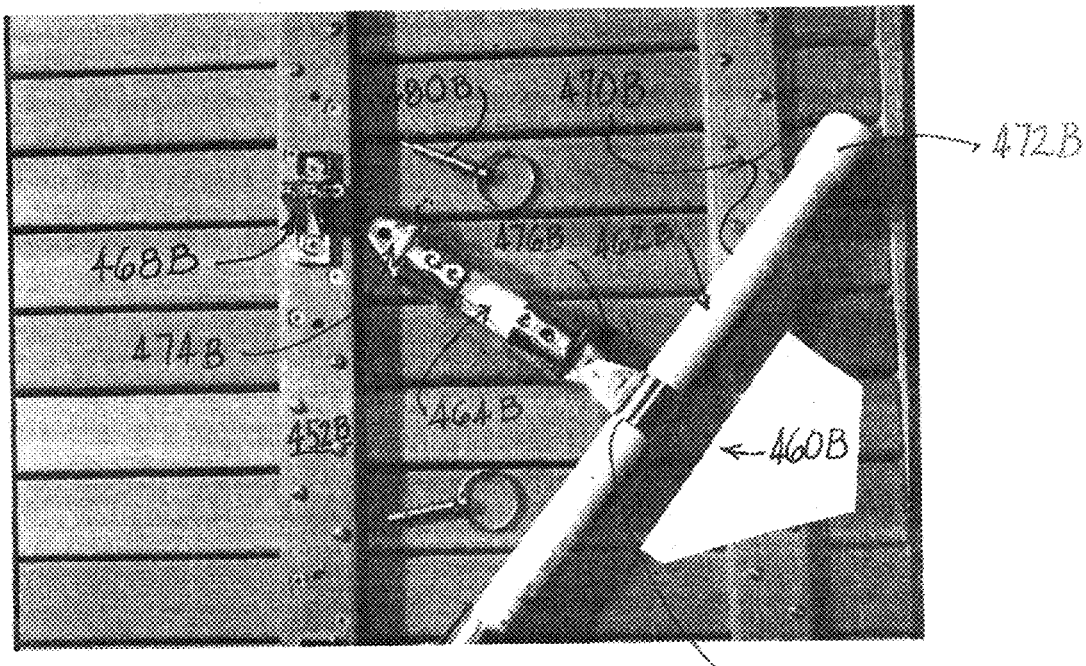
FIGS. 4C and 4D present certain structural details of a leveling mechanism.
Figure 4D:
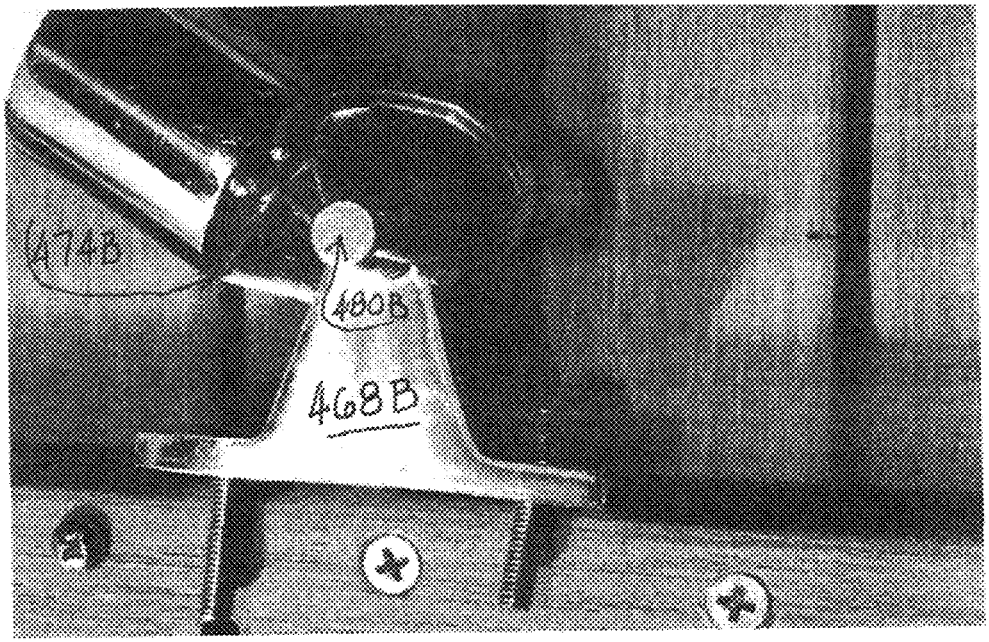

The leveling mechanism 460B includes a first connecting member 462B (FIG. 4B) pivotally connected to a second connecting member 464B (please see FIGS. 2 and 4C). The first connecting member 462B, which in this embodiment is significantly longer than the second connecting member 4648, has opposite end portions, which I shah now describe. One end portion 466B of the first connecting member 462B is pivotally connected (see FIGS. 2, 48) to the centrally-arranged underside board 4528 via a clevis 4688 (see FIGS. 4C, 4D). This clevis 4688 and a second clevis 4688 (please see FIG. 2) are secured to the underside board 452B (FIG. 4C). The opposite end portion 470B of the elongated connecting member 462B includes a foot 472B (FIG. 2) that abuts a preselected portion of the stern 206.

The second connecting member 4648 (FIGS. 2, 4C) has one end portion 474B pivotally attached to table 300B via the other clevis 468B noted above (FIG. 2). In addition, the opposite end portion 476B of the second connecting member 464B is pivotally connected to a sleeve 478B (see FIGS. 2 and 4C) that is sized and shaped to receive and slidingly engage, in certain embodiments frictionally, the first connecting member 462B substantially along its entire length L (FIG. 2) for enabling the upper surface 3028 of the table 300E (FIG. 38) to be oriented substantially level with the landing 202 (FIGS. 1, 2). The one end portion 474B of the second connecting member 464B is secured with a pin 4808 to the clevis 468B (see, e.g., FIGS. 4C, 4D).

Figure 5B:
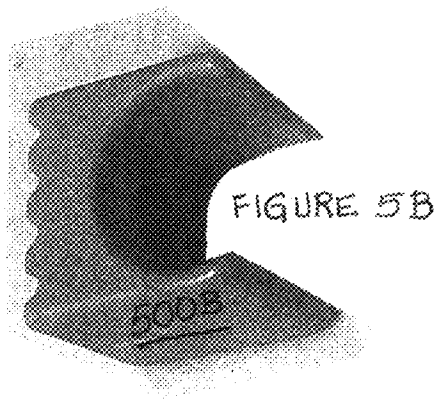
FIGS. 5A 5B, 5C, 5D and 5E provide structural details for those components of the present subject matter that are used to secure the table assembly to a boat.
Figure 5A:
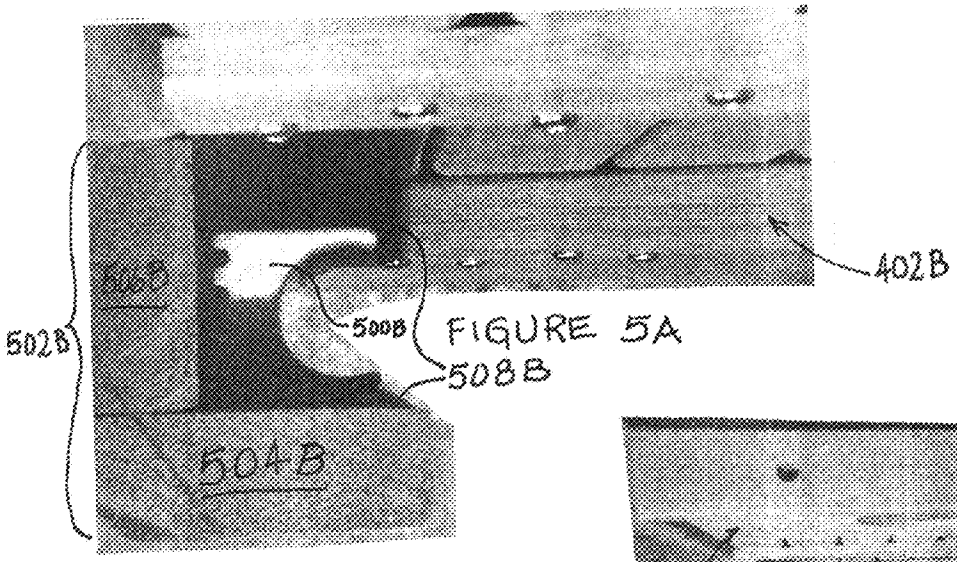
Figure 5C:
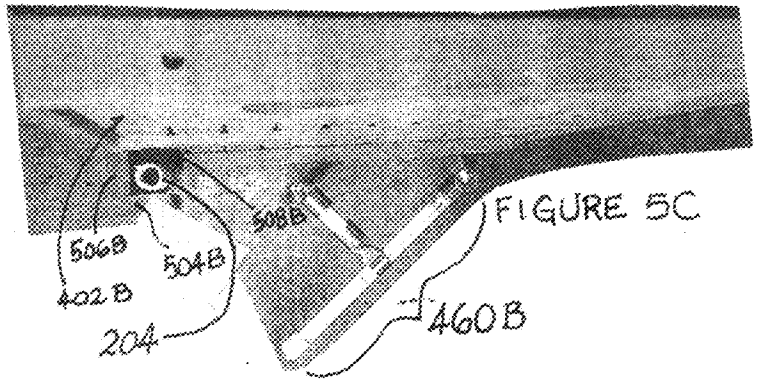

The second embodiment of the table assembly 100 (FIG. 1) of the present subject matter also includes as an essential component—in addition to the table 3008 (FIGS. 38, and 4B) and the leveling mechanism 4608 (FIGS. 48, 4C)—a spaced-apart pair of claws 5008, with a single claw 5008 being shown in FIG. 58. Each one of the pair of claws 500B is contained within a respective one of a pair of spaced-apart housings 502B secured to the underside surface 402B (FIG. 4B) of the table 3008. Each housing 502B includes a floor or shelf 504B and a side wall 506B (please refer to FIG. 5A). The floor or shelf 504B is secured to the underside surface 4028 (FIG. 4B) of the table 3008 by the side wall 5068. Secured to the side wall 5068 and the floor or shelf 5048 (FIG. 5A) of each one of the pair of spaced-apart housings 502B (Hg. 4B) is a retainer 508B (FIG. 5A) configured to secure claw 500B (FIG. 58) to the underside surface 402B (FIGS. 5A, 5C) of table 300B (FIG. 4B).

Figure 5E:
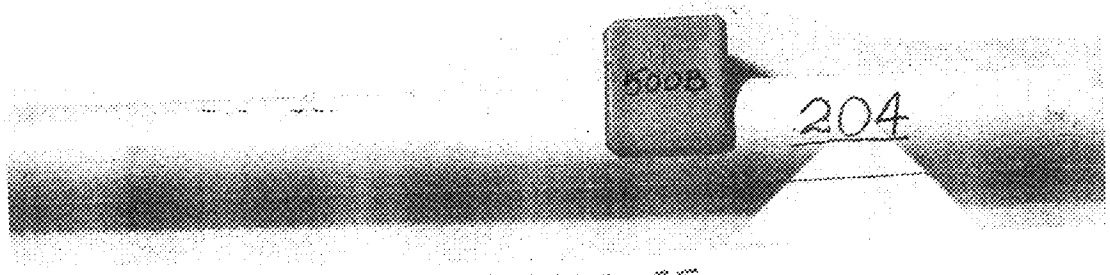

In one embodiment of the present subject matter, a representative grab bar 204 (FIG. 5C) is tubular; and the claws 500B (FIG. 5B) are manufactured from a resilient polymeric material such as nylon, for enabling the claws 500B to be configured to have jaws that snap engage (FIGS. 5C and 5E) the grab bar 204, for removably securing the table 300B of the present subject matter to the stern 206.

Figure 5D:
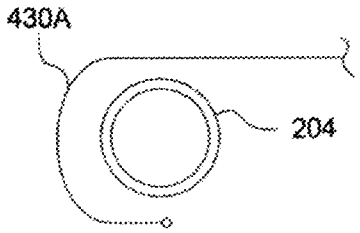

In the other embodiment of the present subject matter, the hooks 430A (FIG. 4A) are so sized and shaped relative to the diameter of the representative grab bar 204 (FIG. 5D) as to enable the table assembly 100 of the present subject matter to be secured to most powered leisure boats having grab bars at the stern. In particular, the hooks 430A can easily be configured to temporarily secure the table assembly 100 to grab bars having cross sections that are circular, square, or any other shape. When the table assembly of the present subject matter is used, there is no need to drill into the boat or attach any special hardware to the boat.

Table components can be made from strips of wood, solid wood portions, strips of wood, or other materials. Wood that can be used includes but is not limited to mahogany, teak, cedar, and other wood products that customers request. Other materials useful as a table component of the present subject matter include but are not limited to various polymeric materials, and assorted composite materials. Also, containers can be made of stainless steel, polymeric, or composite materials. In addition, the bracket of one of the leveling mechanisms of the present subject matter can be made from certain stainless steel grades, aluminum, metals that are resistant to corrosion from seawater, polymeric materials, or composite materials.

What has been illustrated and described is a novel table assembly which I designed for a boat docked near a landing. My table assembly was designed to be temporarily securely mounted to a grab bar. While the present subject matter has been described with reference to exemplary embodiments, the present subject matter is not to be limited to these examples. On the contrary, many alternatives, changes, and/or modifications will become apparent to those of ordinary skill in the field of the present subject matter after this document is read. Thus, all such alternatives, changes, and/or modifications are to be treated as part of the present subject matter insofar as they fall within the spirit and scope of claims that follow.

I claim:

1. A table assembly for a boat docked near a landing, consisting essentially of:
- a table having an upper surface and an underside surface;
- a leveling mechanism secured to the underside surface; and
- a spaced-apart pair of hooks secured to the leveling mechanism, wherein the boat includes:
- a stern; and
- a horizontal member secured to the stern,
- wherein each one of the spaced-apart pair of hooks engages the horizontal member of the boat for securing the table assembly to the stern,
- wherein an end portion of the leveling mechanism abuts the stern, for orienting the upper surface of the table substantially level relative to the landing,
- wherein the table includes a pair of projections extending from the table toward the stern and straddling the pair of hooks, and wherein each one of the projections has an end portion that abuts the horizontal member.

2. The table assembly of claim 1, wherein the leveling mechanism includes:
- a bracket secured to the underside surface of the table; and
- a leveling member having opposite end portions, wherein one end portion defines a foot configured to abut the stern and the opposite end portion is pivotally mounted to the bracket and pivotable about an axis, whereby the foot abuts a predetermined portion of the stern for enabling the upper surface of the table to be oriented substantially level with the landing.

3. The table assembly of claim 1, wherein the table defines a plurality of apertures, each configured to receive a respective one of an associated plurality of containers.

4. The table assembly of claim 1, wherein the upper surface of the table is rectangular, wherein the table upper surface has a width edge margin value and a depth edge margin value, and wherein a ratio defined as the width edge margin value divided by the depth edge margin value ranges from about 2.25 to about 2.5.

5. The table assembly of claim 4, wherein the width edge margin value of the upper surface ranges from about three feet, two inches to about three feet, ten inches.

6. A table assembly for a boat docked near a landing, consisting essentially of:

a table having an upper surface and an underside surface, a leveling mechanism secured to the underside surface; and a spaced-apart pair of claws secured to the underside surface, wherein the boat includes:

a stern and a horizontal member secured to the stern, wherein each one of the spaced-apart pair of claws engages the horizontal member of the boat for securing the table assembly to the stern, wherein an end portion of the leveling mechanism abuts the stern for orienting the upper surface of the table substantially level relative to the landing, wherein the leveling mechanism includes:

a first connecting member defining a length and opposite end portions, wherein one end portion of the first connecting member is pivotally secured to the table and the other end portion of the first connecting member comprises a foot abutting a preselected portion of the stern, and a second connecting member having opposite end portions, wherein one end portion of the second connecting member is pivotally secured to the table and the other end portion of the second connecting member is pivotally connected to a sleeve configured to receive the first connecting member along the length of the first connecting member for enabling the table upper surface to be oriented substantially level with the landing.

7. The table assembly of claim 6, wherein the sleeve frictionally engages the first connecting member along the length of the first connecting member for enabling the upper surface of the table to be maintained substantially level with the landing.

8. The table assembly of claim 6, wherein the table defines a plurality of apertures, each configured to receive a respective one of an associated plurality of containers.

* * * * *